US006208232B1

(12) United States Patent
Chen

(10) Patent No.: US 6,208,232 B1
(45) **Date of Patent: *Mar. 27, 2001**

(54) DUMMY PIN STRUCTURE FOR A MINIATURE TRANSFORMER

(75) Inventor: James Chien-Chung Chen, Taipei (TW)

(73) Assignee: Atech Technology Co., Ltd., Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,637

(22) Filed: Feb. 16, 1999

(51) Int. Cl.[7] ..... H01F 27/29
(52) U.S. Cl. ..... 336/192; 336/107; 336/198
(58) Field of Search ..... 336/192, 198, 336/208; 242/125, 125.1, 125.2, 125.3, 379; 439/449

(56) References Cited

U.S. PATENT DOCUMENTS 5,034,854 * 7/1991 Matsumura et al. ..... 361/396
5,264,816 * 11/1993 Degenhart et al. ..... 336/192
5,307,041 * 4/1994 Kato et al. ..... 336/83
5,359,313 * 10/1994 Watanabe et al. ..... 336/178
5,396,211 * 3/1995 Noguchi et al. ..... 336/92
5,656,985 * 8/1997 Lu et al. ..... 336/96
5,751,203 * 5/1998 Tsutsumi et al. ..... 336/65
5,859,577 * 1/1999 Nihei et al. ..... 336/92
5,903,202 * 5/1999 Endoh et al. ..... 335/151

* cited by examiner

*Primary Examiner*—Michael L. Gellner
*Assistant Examiner*—Tuyen T. Nguyen
(74) *Attorney, Agent, or Firm*—Dougherty & Troxell

(57) ABSTRACT

A miniature transformer is provided at each end surface of a bobbin thereof with two spaced principal pins and two spaced dummy pins located between the two spaced principal pins. The dummy pin each is an integral extension from a rear end of an extended rear section of one adjacent principal pin embedded in the bobbin. The extended rear section extends obliquely forward toward a central area of the end surface of the bobbin and then turns straight forward to project from the end surface to form the dummy pin. The dummy pin each is provided at an inner side with a curved notch for a lead from windings on the miniature transformer to wind around there without further reducing a small distance between two adjacent dummy pins. Since the dummy pins are located between and shorter than the principal pins, they are protected by the principal pins without being easily touched or pulled to cause broken leads that would result in high bad yield in the production of the miniature transformer.

1 Claim, 5 Drawing Sheets

DUMMY PIN STRUCTURE FOR A MINIATURE TRANSFORMER

BACKGROUND OF THE INVENTION

The present invention relates to dummy pins for a miniature transformer, and more particularly to dummy pins for a miniature transformer that are integral extensions of principal pins projected from two ends of a bobbin of the transformer. The dummy pins at each end of the bobbin are located between and shorter than the principal pins and are provided at an inner side with a curved notch for leads on the transformer to wind around the dummy pins at the curved notches instead of the principal pins, so as to avoid broken leads that results in high bad yield in the production of the miniature transformer.

A transformer is an important and necessary component in an electronic circuit. With the development of dimensionally minimized circuit board, the transformer for mounting on the circuit board must be as small as possible in volume without sacrificing its intended functions. A conventional miniature transformer includes a bobbin, windings (including first and second windings), a core, and pins projected from two end surfaces of the bobbin. The transformer has dimensions as small as 18 mm (L)×8.5 mm (W)×4.4 mm (H). A small space generally equal to the volume of the transformer must be prepared on the circuit board for mounting the transformer. For such a small transformer to achieve the intended high performance within a given or extremely limited volume, it is basically necessary to reduce the diameter and increase the turns of the copper wire for forming the windings. Such miniature transformer is particularly needed in the designs of, for example, modems for notebook computers and/or card-type portable modems that have a transmission speed as high as 33.6 K or 56 K BPS. However, following confusions are often found with currently commercially available miniature transformers:

1. The first and second windings of the miniature transformer have their own leads that are guided to wind around the pins at two end surfaces of the bobbin. Such leads are so tiny that they tend to break when the pins are subject to an external force in the process of manufacturing the transformer. A high bad yield up to 2% in the production of the miniature transformer is therefore frequently caused. In other words, quality control in the mass production of conventional miniature transformer is uneasy and the manufacturing cost thereof is increased, accordingly.
2. The fine leads having been wound around the pins are subject to another possible breaking caused by external force against it and/or touch of it in the process of mounting the completed miniature transformer on the circuit board. This would cause a reduced reliability of the finished product and would have big influence on a good image of the product.

It is therefore necessary to develop dummy pins for a miniature transformer to facilitate the mass production and enhance the durable use thereof.

SUMMARY OF THE INVENTION

A primary object of the present invention is to provide a dummy pin structure for a miniature transformer. The dummy pin according to the present invention is formed by integrally extending a rear end of a principal pin obliquely forward toward a central area of the end surface of the bobbin and then turning straight forward to project from the end surface of the bobbin. The rear ends of the principal pins and the oblique parts of the dummy pins are actually an integral piece and are firmly embedded in the bobbin when the bobbin is injection molded. The dummy pins at each end surface of the bobbin are located between and shorter than two principal pins and are therefore protected by them from external force. By guiding and winding leads of the transformer around the dummy pins instead of the principal pins, the leads are not subject to easy breaking due to external force during manufacturing and using of the miniature transformer.

Another object of the present invention is to provide a dummy pin structure for a miniature transformer. The transformer has principal pins and each of the principal pins has an extended rear portion embedded in the bobbin of the transformer. The extended rear portion of the principal pin obliquely extends forward toward a central area of the end surface of the bobbin at an optimal angle to form a shorter and integral dummy pin that projects from the end surface of the bobbin to locate between two principal pins. Such arrangement requires minimum space and facilitates firm and stable location of the dummy pins in the bobbin when the same is injection molded.

A further object of the present invention is to provide a dummy pin structure for a miniature transformer. Wherein the dummy pin each is provided at an inner side with a curved notch for a lead of the transformer to wind around there without undesirably contacting with the lead wound around an adjacent dummy pin, so that the quality and reliability of the transformer can be well controlled.

DETAILED DESCRIPTION OF THE PREFERRED EMBODIMENTS

Figure 1:
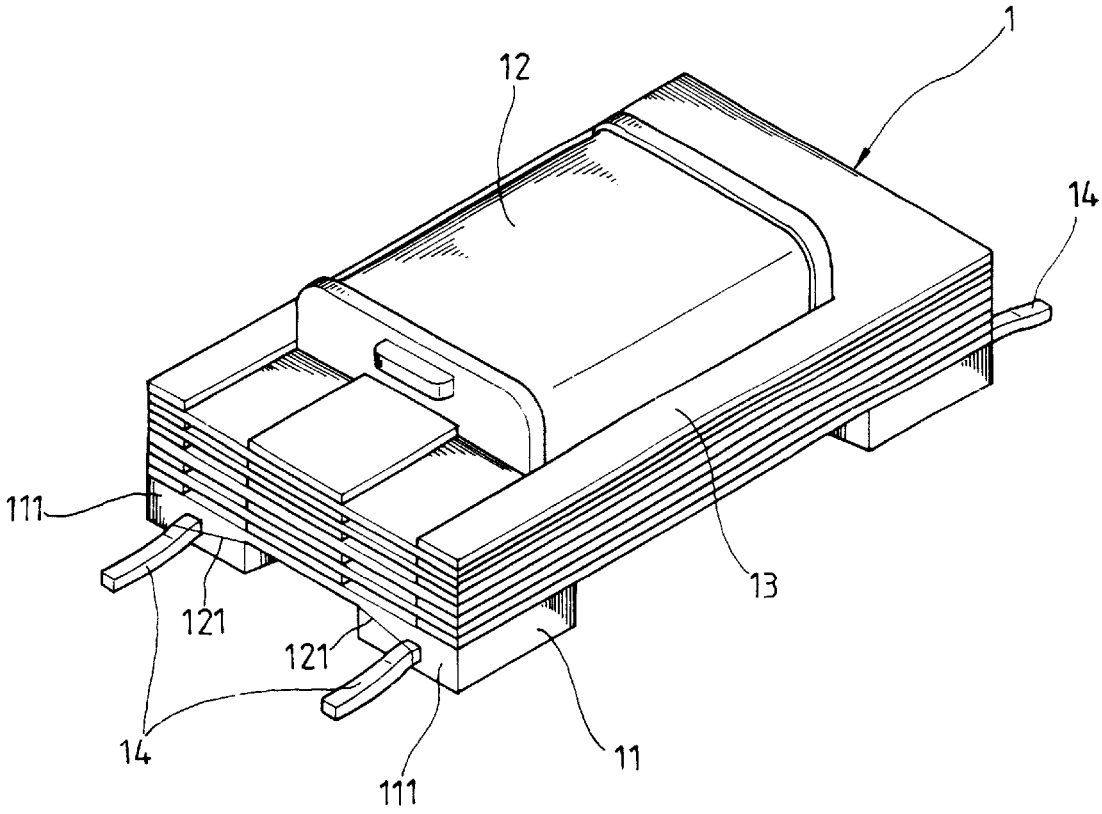
FIG. 1 (PRIOR ART)
FIG. 1 is a perspective of a conventional miniature transformer.
Figure 2:
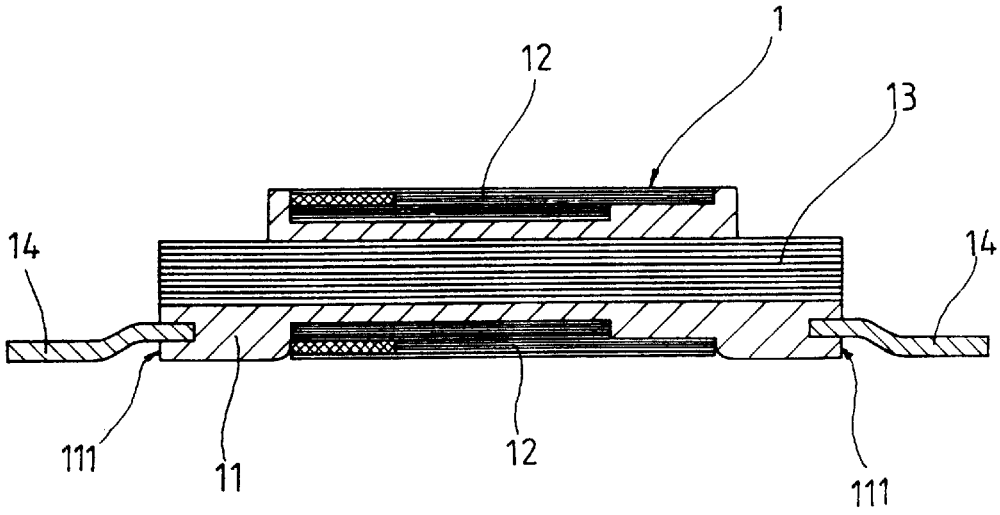
FIG. 2 (PRIOR ART)
FIG. 2 is a side sectional view of the miniature transformer of FIG. 1.

Please first refer to FIGS. 1 and 2 that are perspective and side sectional views, respectively, of a currently commercially available miniature transformer 1. As shown, the miniature transformer 1 basically includes a bobbin 11, windings 12, a core 13, and pins 14. The windings 12 include a first winding and a second winding. Both the first and the second windings include a beginning and an end that serve as leads 121 of the windings 12. The leads 121 are guided through a channel formed at a bottom surface of the bobbin 11 toward two ends of the bobbin 11 to be wound around pins 14 projected from two end surfaces 111 of the bobbin 11. There are two spaced pins 14 provided at each end surface 111 of the bobbin. When forming the pins 14, they are bent in directions and at angles depending on the actual need in design (such as to mount the miniature transformer on a circuit board in a manner shown in FIG. 7). Moreover, the pins 14 are directly positioned in a mold cavity for injection molding the bobbin 11, so that the formed bobbin 11 has sufficient thickness to firmly hold the pins 14.

In the above-described miniature transformer 1, the leads 121 are so tiny that they tend to break when they are touched or pulled by an external force. Since each lead 121 itself has an end pulled from the winding and another end fixedly wound around the pin 14, the lead 121 is generally in a tensional condition. On the other hand, the pins 14 are frequently subject to collision or external force in the process of manufacturing and using the miniature transformer 1 that frequently results in broken leads 121. There is a bad yield in the production of such miniature transformer 1 as high as 2% that is usually caused by broken leads 121. The high bad yield has adversely and largely increased the manufacture cost of the miniature transformers 1.

Figure 3:
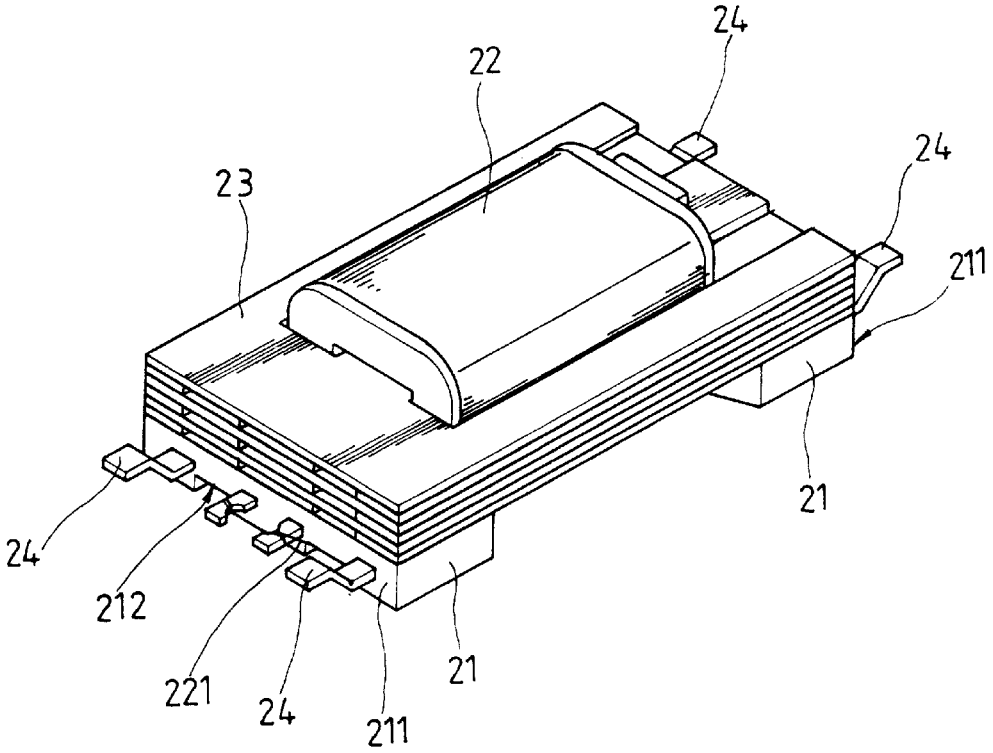
FIG. 3 is a perspective of a miniature transformer having the dummy pins according to the present invention.
Figure 4:
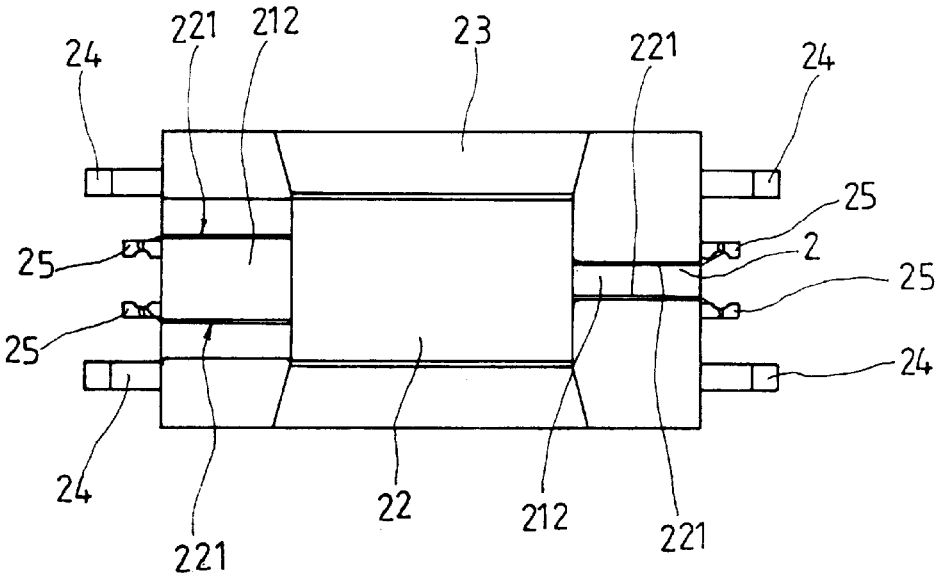
FIG. 4 is a bottom plan view of the miniature transformer of FIG. 3.
Figure 5:
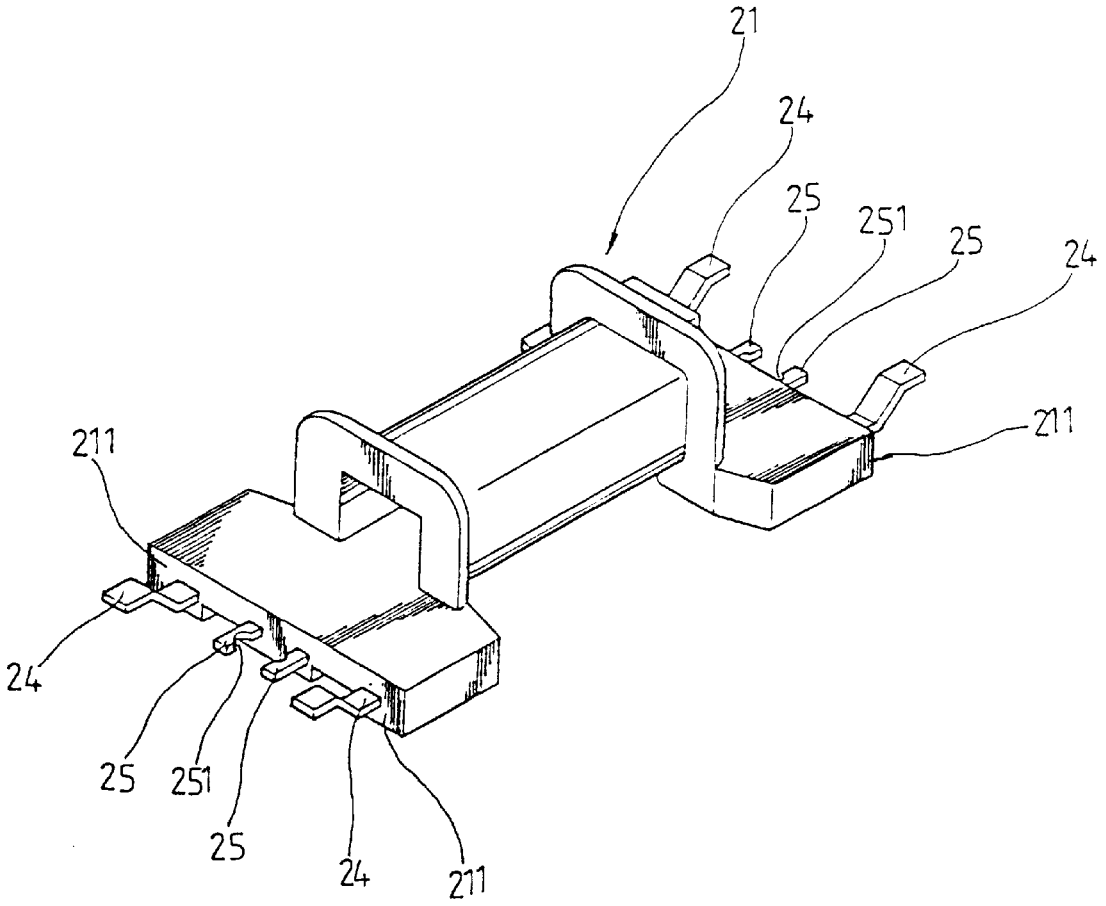
FIG. 5 is a perspective of a first embodiment of the bobbin used in the miniature transformer of FIG. 3.

Please refer to FIGS. 3 and 4 that are perspective and bottom views, respectively, of a miniature transformer 2 having dummy pins according to the present invention. The miniature transformer 2 is generally similar to the currently commercially available miniature transformer 1 and includes a bobbin 21, windings 22, a core 23, and two spaced pins 24 projected from each end surface 211 of the bobbin 21. However, the miniature transformer 2 is different from the conventional miniature transformer 1 in that it has another two spaced pins 25 projected from each end surface 211 of the bobbin 21 to locate between the original two pins 24. To easily distinguish the pins 24 from the pins 25, the pins 24 shall be hereinafter referred to as the principal pins 24 while the pins 25 as the dummy pins 25. The dummy pins 25 at each end of the bobbin 21 are not only located between the principal pins 24 but also shorter than them, whereby the longer principal pins 24 form protectors of the shorter dummy pins 25 to protect the dummy pins 25 from external force. FIG. 5 is a perspective of the bobbin 21 clearly showing positions of the principal and the dummy pins 24, 25 on two end surfaces 211 of the bobbin 21.

Figure 6:
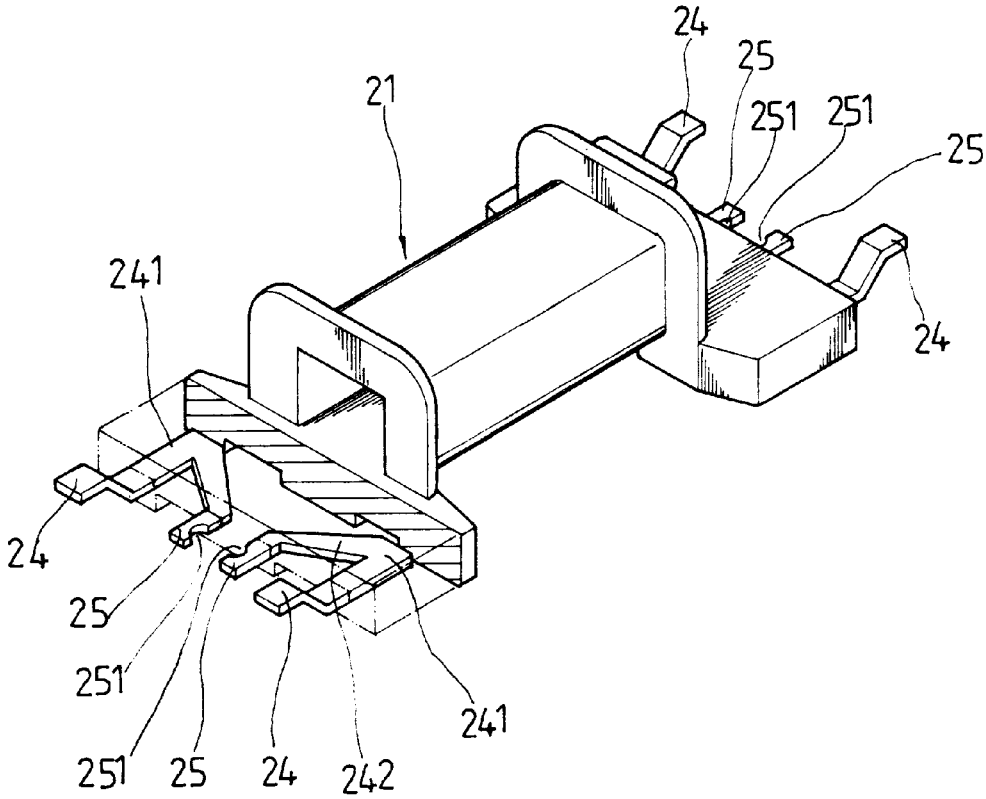
FIG. 6 is a perspective of the bobbin of FIG. 5 with a part thereof cut away to show the dummy pin structure for the miniature transformer of FIG. 3.

Please go to FIG. 6 in which the bobbin 21 is shown with a part thereof being cut away. As can be clearly seen from the drawing, each dummy pin 25 is actually an extension of is a principal pin 24. That is, the dummy pin 25 and its adjacent principal pin 24 are formed from an integral sheet material. A portion of the principal pin 24 embedded in the bobbin 21 during injection molding extends from a rear end thereof obliquely forward toward a central area of the end surface 211 and then turns straight forward to project from the end surface 211, forming a dummy pin 25. Since the end surfaces 211 of the bobbin 21 have only limited thickness and that is further decreased by a channel 212 provided at a bottom surface of the bobbin 21 for guiding leads 221 to the pins at two ends of the bobbin 21 (see FIG. 4), only a proper arrangement could allow two additional dummy pins 25 to be provided and firmly located at the small end surfaces 211 in parallel with the principal pins 24. The arrangement of pins 24 and 25 on the end surfaces 211 of the bobbin 21 shown in FIG. 6 is a preferred embodiment of the present invention. In this preferred embodiment, the principal pin 24 each is formed from a flat plate and has a properly extended rear section 241 embedded in the bobbin 21. The properly extended rear section 241 firmly and stably buried in the end portion 211 of the bobbin 21. It is the extended rear portion 241 that extends from a rear end thereof obliquely forward toward the central area of the end surface 211 to form an oblique section 242. The oblique section 242 then turns straight forward to project from the end surface 211 of the bobbin 21 to form the dummy pin 25. With this arrangement, the extended rear section 241 and the oblique section 242, that are actually two parts of an integral plate forming the principal pin 24 and the dummy pin 25, would occupy a minimum space in the bobbin 21 without affecting an original design of the bobbin 21. Meanwhile, they together have sufficient strength to avoid any deviation of their position in the bobbin 21 when the bobbin 21 is injection molded. That is, the extended rear section 241 and the oblique section 242 shown in FIG. 6 together allow the dummy pin 25 to project from the end surface 211 of the bobbin 21 via an expected and desired position without causing difficulties in mass production and quality control of the miniature transformer 2.

The purpose of providing the dummy pins 25 on the bobbin 21 is to wind leads 221 around the dummy pins 25 instead of the principal pins 24. Since the shorter dummy pins 25 are protected by the longer principal pins 24 at two outer sides of the dummy pins 25, leads 221 wound around the dummy pins 25 are not easily subject to touches or pulls and breaking, accordingly, during the manufacturing and using of the miniature transformer 2. As can be seen from FIGS. 3, 4, 5 and 6, the dummy pin 25 each is provided at an inner side facing away from its principal pin 24 with a suitably sized curved notch 251. The notch 251 allows the lead 221 to wind around the dummy pin 25 at the notch 251 without protruding from the inner side of the dummy pin 25 to further dangerously reduce a very small distance between two adjacent dummy pins 25. Moreover, the notch 251 prevents the lead 221 wound around it from undesirably moving and deviation in position and is therefore helpful in the process control of winding the leads 221 around the dummy pins 25.

Figure 7:
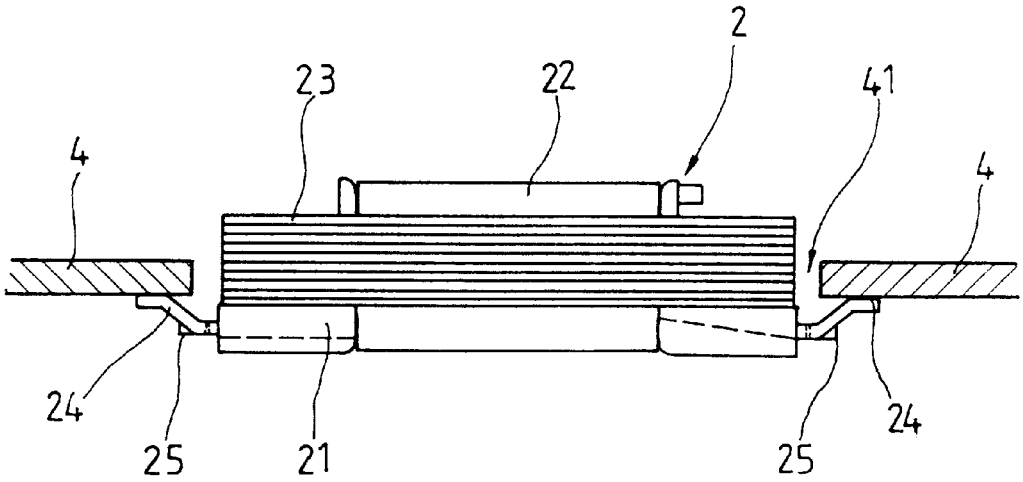
FIG. 7 is a side sectional view showing the manner of connecting the miniature transformer of FIG. 3 to a circuit board.

When the miniature transformer 2 is to be mounted on a circuit board 4 that is thin, light, and small in dimensions, an insertion hole 41 may be first formed on the circuit board 4 for receiving the transformer 2 therein, as shown in FIG. 7. By this way, a distance by which the miniature transformer 2 would protrude from either a top or a bottom surface of the circuit board 4 could be minimized. To cooperate with the insertion hole 41 formed on the circuit board 4, the principal pins 24 are so bent that they are suitable for connecting to the bottom surface of the circuit board 4 without causing the shorter dummy pins 25 located between them to contact with the circuit board 4. Since each principal pin 24 and its adjacent dummy pin 25 are formed from an integral piece of sheet material and the extended rear section 241 and the oblique section 242 are firmly and stably embedded in the bobbin 21, any external force applied on the principal pins 24 would not directly affect the firm location of their adjacent dummy pins 25 in the bobbin 21. As a result, the leads 221 wound around the dummy pins 25 are well protected as intended for the present invention.

Figure 8:
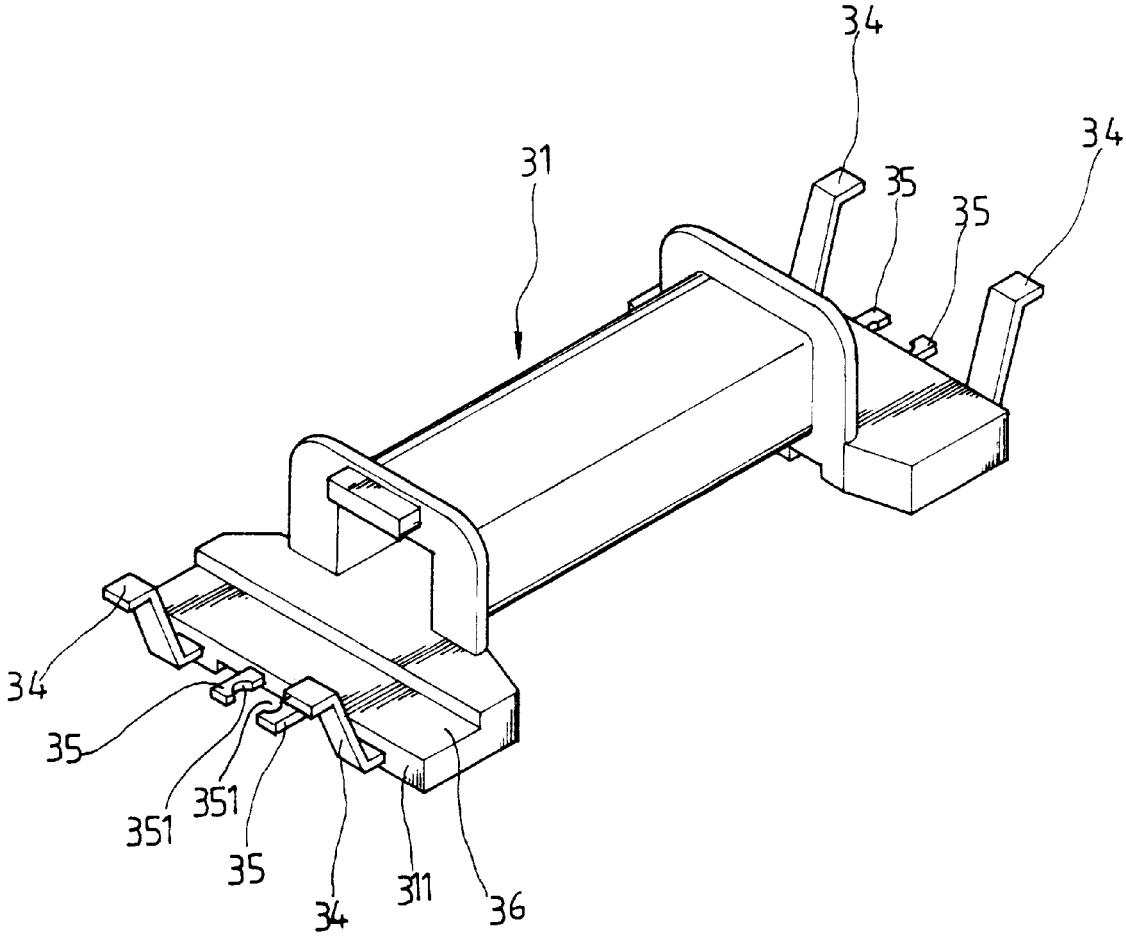
FIG. 8 is a perspective of another embodiment of the bobbin used in the miniature transformer of FIG. 3.

FIG. 8 illustrates another bobbin 31 that is also frequently used in forming the miniature transformer 2. The bobbin 31 is characterized by a stepped end that provides a recess 36 adjacent to one end surface 311 of the bobbin 31. After a core (not shown in FIG. 8) is mounted on the bobbin 31, there is a clearance between the core and the recess 36. A generally U-shaped insulating member (not shown) having lower and upper walls is used to cover an end of the core above the stepped end of the bobbin 31 by inserting the lower wall of the insulating member into the clearance between the core and the recess 36. The provision of the recess 36 on one end of the bobbin 31 would apparently further decrease the thickness of the end surface 311 of the bobbin 31. However, principal and dummy pins 34 and 35, respectively, according to the present invention are also applicable in this type of bobbin 31 to achieve the objects of the present invention. The dummy pins 35 are also provided at their inner sides with curved notches 351 to ensure firm winding of leads (not shown) around the dummy pins 35.

What is claimed is:

1. A dummy pin structure for a miniature transformer, said miniature transformer including a bobbin having first and second oppositely disposed end surfaces and first and second principle pins projecting from each of said end surfaces, said dummy pin structure comprising first and second spaced dummy pins projecting from each of said first and second oppositely disposed end surfaces, said first and second dummy pins disposed between and parallel with said first and second principle pins, a first oblique section integrally formed with and connecting said first principle pin and said first dummy pin to form a generally U-shaped structure wherein said first oblique section forms an acute angle with said first principle pin and an oblique angle with said first dummy pin, a second oblique section integrally formed with and connecting said second principle pin and said second dummy pin to form a generally U-shaped structure wherein said second oblique section forms an acute angle with said second principle pin and an oblique angle with said second dummy pin and said dummy pins being shorter than said principle pins and each provided at an inner side with a curved notch for a lead from windings on said miniature transformer to wind therearound, and wherein each of said principle pins, dummy pins and oblique sections are formed from a flat plate and each of said principle pins being bent to form a riser for contacting a circuit board without causing the shorter dummy pins located between the principle pins to contact the circuit board.

* * * * *